US006470529B1

(12) United States Patent
Chang

(10) Patent No.: US 6,470,529 B1
(45) Date of Patent: Oct. 29, 2002

(54) RETRACTABLE HANDLE ASSEMBLY

(76) Inventor: Wen-Chen Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/897,838

(22) Filed: Jun. 28, 2001

(51) Int. Cl.[7] ..... A45C 7/00

(52) U.S. Cl. ..... 16/113.1; 190/39; 190/115; 280/655; 280/655.1; 280/47.26

(58) Field of Search ..... 16/113.1; 190/115, 190/39; 280/655.1, 655, 47.26

(56) References Cited

U.S. PATENT DOCUMENTS 5,400,472 A * 3/1995 Chang ..... 16/115
5,639,109 A * 6/1997 Liang ..... 280/655
5,655,260 A * 8/1997 Chang ..... 16/115
5,692,266 A * 12/1997 Tsai ..... 16/115
5,803,214 A * 9/1998 Wang ..... 190/115
5,816,375 A * 10/1998 Tu ..... 16/115
5,875,520 A * 3/1999 Chang ..... 16/115
6,026,543 A * 2/2000 Chen ..... 16/113.1
6,128,806 A * 10/2000 Shou-Mao ..... 16/113.1
6,223,391 B1 * 5/2001 Kuo ..... 16/113.1
6,223,392 B1 * 5/2001 Chang ..... 16/113.1
6,295,698 B1 * 10/2001 Chang ..... 16/113.1
6,332,241 B1 * 12/2001 Kuo ..... 16/113.1

* cited by examiner

*Primary Examiner*—Thomas B. Will
*Assistant Examiner*—Alexandar K. Pechhold

(57) ABSTRACT

A retractable handle assembly has a fixed seat, a grip device disposed in the fixed seat, a pair of cubic blocks, a pair of driven rods, a pair of inner pipes, a pair of middle pipes, a pair of outer pipes, a base seat, a pair of first positioning devices, and a pair of second positioning devices. The fixed seat has two oblong apertures. The grip device has a U-shaped seat disposed in the fixed seat. The U-shaped seat has two downward sleeves. The inner pipes are inserted through the downward sleeves. The cubic blocks are inserted in the inner pipes. The driven rods are inserted in the inner pipes. The inner pipes are inserted in the middle pipes. The middle pipes are inserted in the outer pipes. Each first positioning device is disposed on a bottom of the corresponding inner pipe. Each second positioning device is disposed on a bottom of the corresponding middle pipe.

1 Claim, 8 Drawing Sheets

RETRACTABLE HANDLE ASSEMBLY

BACKGROUND OF THE INVENTION

The present invention relates to a retractable handle assembly. More particularly, the present invention relates to a retractable handle assembly for a suitcase.

Referring to FIGS. 1 to 4, a conventional re-tractable handle assembly has a fixed seat 25, a grip device 24 disposed in the fixed seat 25, a pair of cubic blocks 260, a pair of driven rods 26, a pair of inner pipes 19, a pair of middle pipes 20, a pair of outer pipes 21, a base seat 27, a pair of first positioning devices 100, and a pair of second positioning devices 100. The fixed seat 25 has two oblong apertures 251. The grip device 24 has a U-shaped seat 243 disposed in the fixed seat 25, a button plate 247 disposed in the U-shaped seat 243, two springs 248 disposed between the button plate 247 and the U-shaped seat 243, and a cover plate 245 engaging with the button plate 247. The U-shaped seat 243 has two downward sleeves 244 matching the oblong apertures 251 of the fixed seat 25. The cover plate 245 has a center hole 246. The inner pipes 19 are inserted through the downward sleeves 244. The cubic blocks 260 are inserted in the inner pipes 19. The base seat 27 has two upward sleeves 28 for receiving the outer pipes 21. The driven rods 26 are inserted in the inner pipes 19. The inner pipes 19 are inserted in the middle pipes 20. The middle pipes 20 are inserted in the outer pipes 21. Each of the inner pipes 19 has a circular hole 191. Each of the middle pipes 20 has a round hole 22. Each of the outer pipes 21 has a circular aperture 23 and a round aperture 240. Each of the first positioning devices 100 is disposed on a bottom of the corresponding inner pipe 19. Each of the second positioning devices 100 is disposed on a bottom of the corresponding middle pipe 20. Each of the first and the second positioning devices 100 has a mount 1, a cover block 6 engaging with the mount 1, a shaft 5, and a movable block 4. The mount 1 has a channel 2 for receiving the movable block 4, a hollow column 3 for receiving the shaft 5, an inner post 7, and a bottom groove 13. The cover block 6 has an inner pillar 10 and a hook plate 14. The shaft 5 has an end protrusion 9 and two lateral posts 18. An elastic element 11 is disposed in the mount 1 and the inner post 7 is inserted in the elastic element 11. The movable block 4 has a bottom portion 16, a top portion 15, two lateral slant holes 17, and a bottom post 8 disposed on the bottom portion 16. The hook plate 14 is inserted in the bottom groove 13 of the mount 1. A coiled spring 12 is disposed between the inner pillar 10 and the end protrusion 9 of the shaft 5. The lateral posts 18 are inserted through the lateral slant holes 17 of the movable block 4. The movable block 4 moves along the channel 2 of the mount 1. The shaft 5 moves along the hollow column 3 of the mount 1. The movable block 4 is pushed upward by the elastic element 11. The lateral posts 18 moves along the lateral slant holes 17 of the movable block 4. When the button plate 247 is pressed downward, the driven rods 26 are driven to press the movable block 4 downward. Then the shaft 5 enters the hollow column 3 of the mount 1. However, a user should press the button plate 247 forcefully.

SUMMARY OF THE INVENTION

An object of the present invention is to provide a retractable handle assembly which can be operated easily.

Another object of the present invention is to provide a retractable handle assembly which can be assembled easily.

Accordingly, a retractable handle assembly comprises a fixed seat, a grip device disposed in the fixed seat, a pair of cubic blocks, a pair of driven rods, a pair of inner pipes, a pair of middle pipes, a pair of outer pipes, a base seat, a pair of first positioning devices, and a pair of second positioning devices. The fixed seat has two oblong apertures. The grip device has a U-shaped seat disposed in the fixed seat, a button plate disposed in the U-shaped seat, two springs disposed between the button plate and the U-shaped seat, and a cover plate engaging with the button plate. The U-shaped seat has two downward sleeves matching the oblong apertures of the fixed seat. The cover plate has a center hole. The inner pipes are inserted through the downward sleeves, The cubic blocks are inserted in the inner pipes. The base seat has two upward sleeves for receiving the outer pipes. The driven rods are inserted in the inner pipes. The inner pipes are inserted in the middle pipes. The middle pipes are inserted in the outer pipes. Each of the inner pipes has a circular hole. Each of the middle pipes has a round hole. Each of the outer pipes has a circular aperture and a round aperture. Each of the first positioning devices is disposed on a bottom of the corresponding inner pipe. Each of the second positioning devices is disposed on a bottom of the corresponding middle pipe. Each of the first and the second positioning devices has a mount, a clamp device, a hollow cube, a plug, a helical spring, and a coiled spring. The mount has two lateral slide channels, a guide channel, and an oblong hole communicating with the guide channel. The clamp device has two elastic arms and two end posts disposed on the elastic arms. The hollow cube has a chamber, a U-shaped stepped flange, an opening, two lateral slant holes, and a disk. The plug has a column and a pillar. The plug is disposed in the chamber of the hollow cube. The column is confined by the U-shaped stepped flange. The helical spring is disposed between the plug and the hollow cube. The pillar is inserted in the helical spring. The coiled spring is inserted in the guide channel of the mount. The hollow cube is inserted in the guide channel of the mount. The elastic arms are inserted in the lateral slide channels of the mount. The end posts are inserted in the lateral slant holes of the hollow cube.

DETAILED DESCRIPTION OF THE INVENTION

Figure 1:
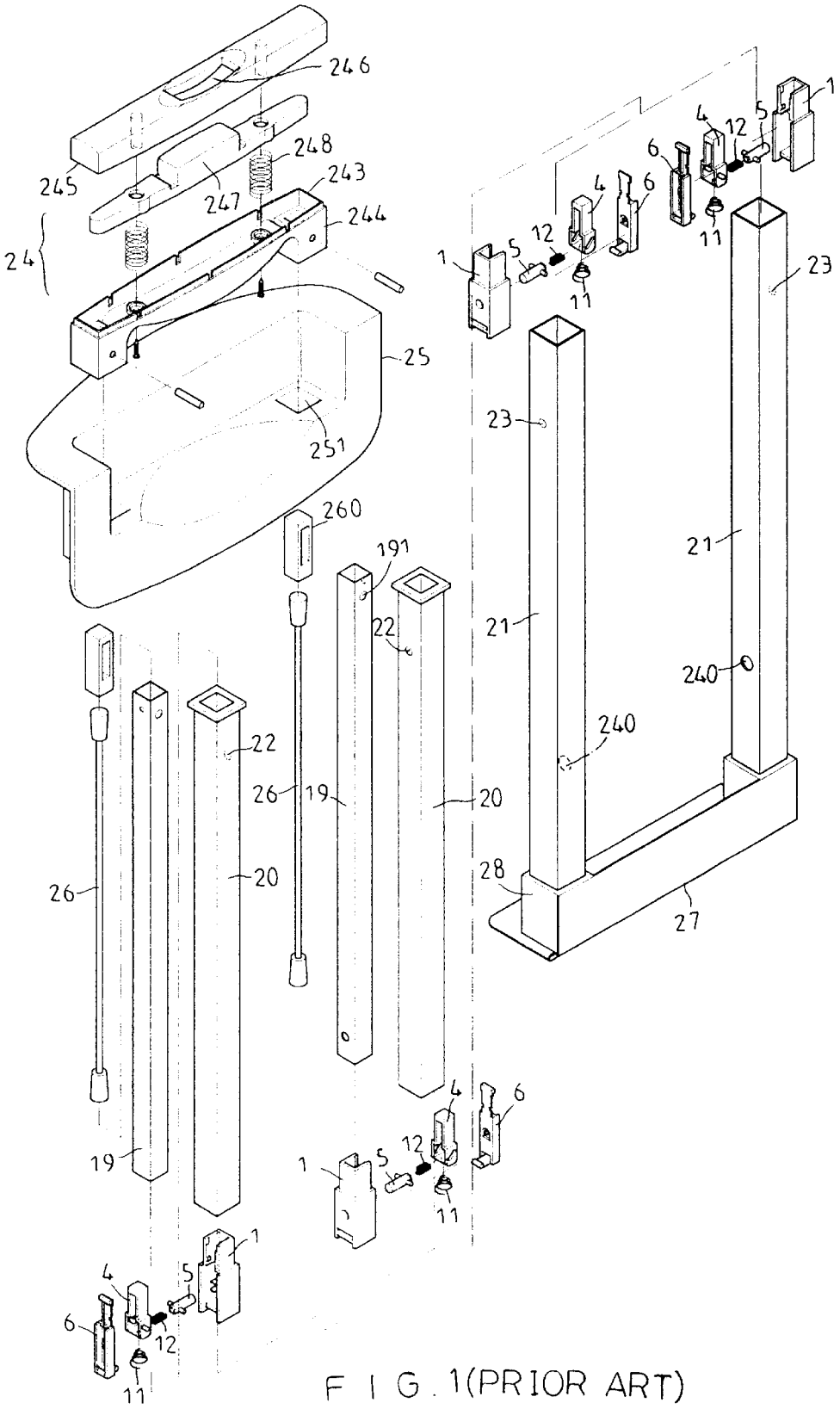
F I G. 1(PRIOR ART)
FIG. 1 is a perspective exploded view of a retractable handle assembly of the prior art.
Figure 2:
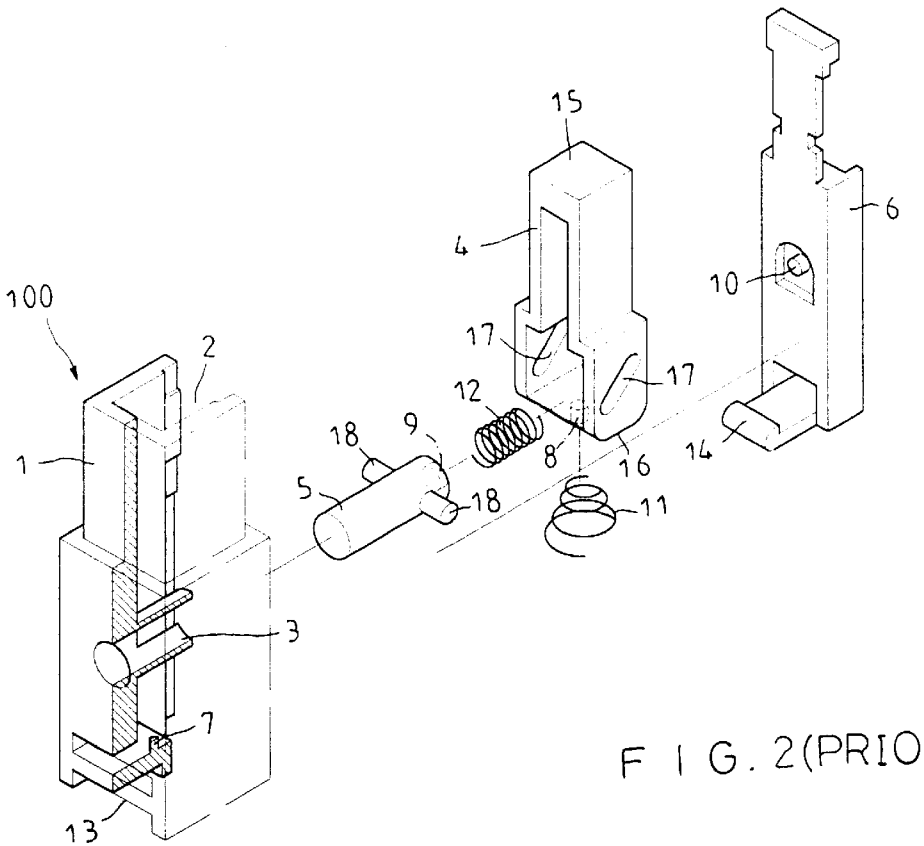
FIG. 2(PRIOR ART)
FIG. 2 is a perspective exploded view of a positioning device of the prior art.
Figure 3:
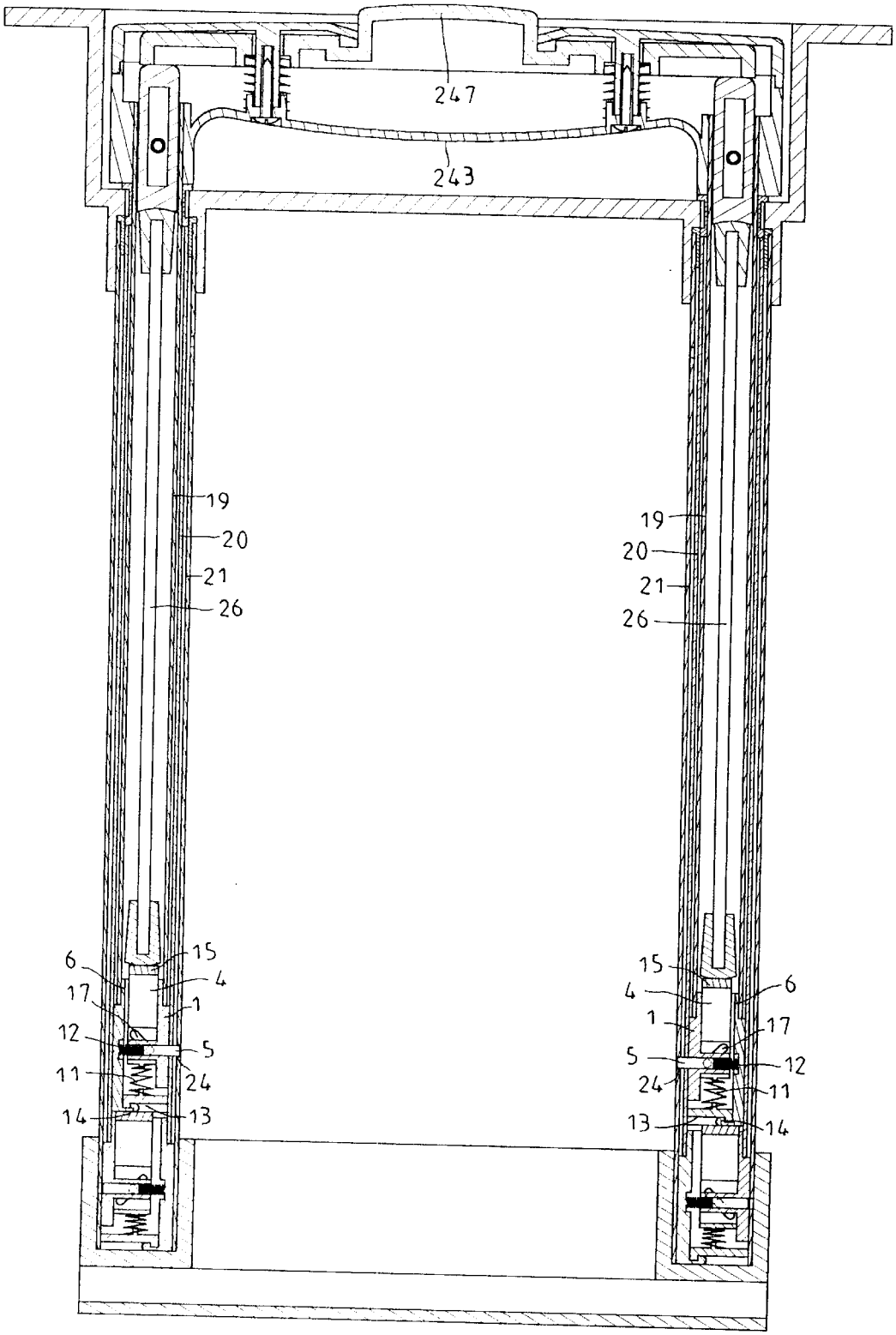
F I G. 3(PRIOR ART)
FIG. 3 is a sectional assembly view of a retractable handle assembly of the prior art.
Figure 4:
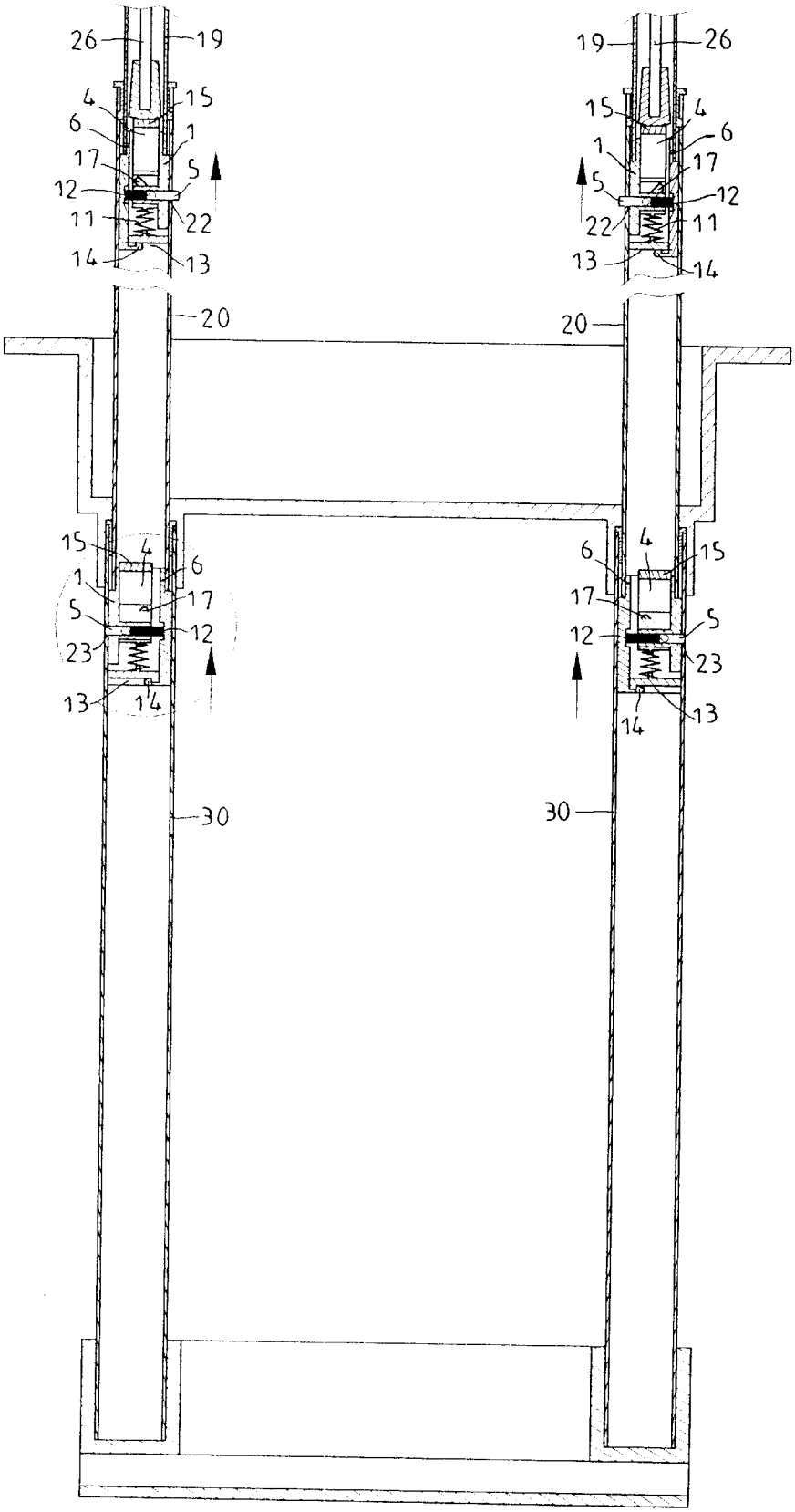
F I G. 4 (PRIOR ART)
FIG. 4 is a sectional schematic view illustrating an operation of a retractable handle assembly of the prior art.
Figure 5:
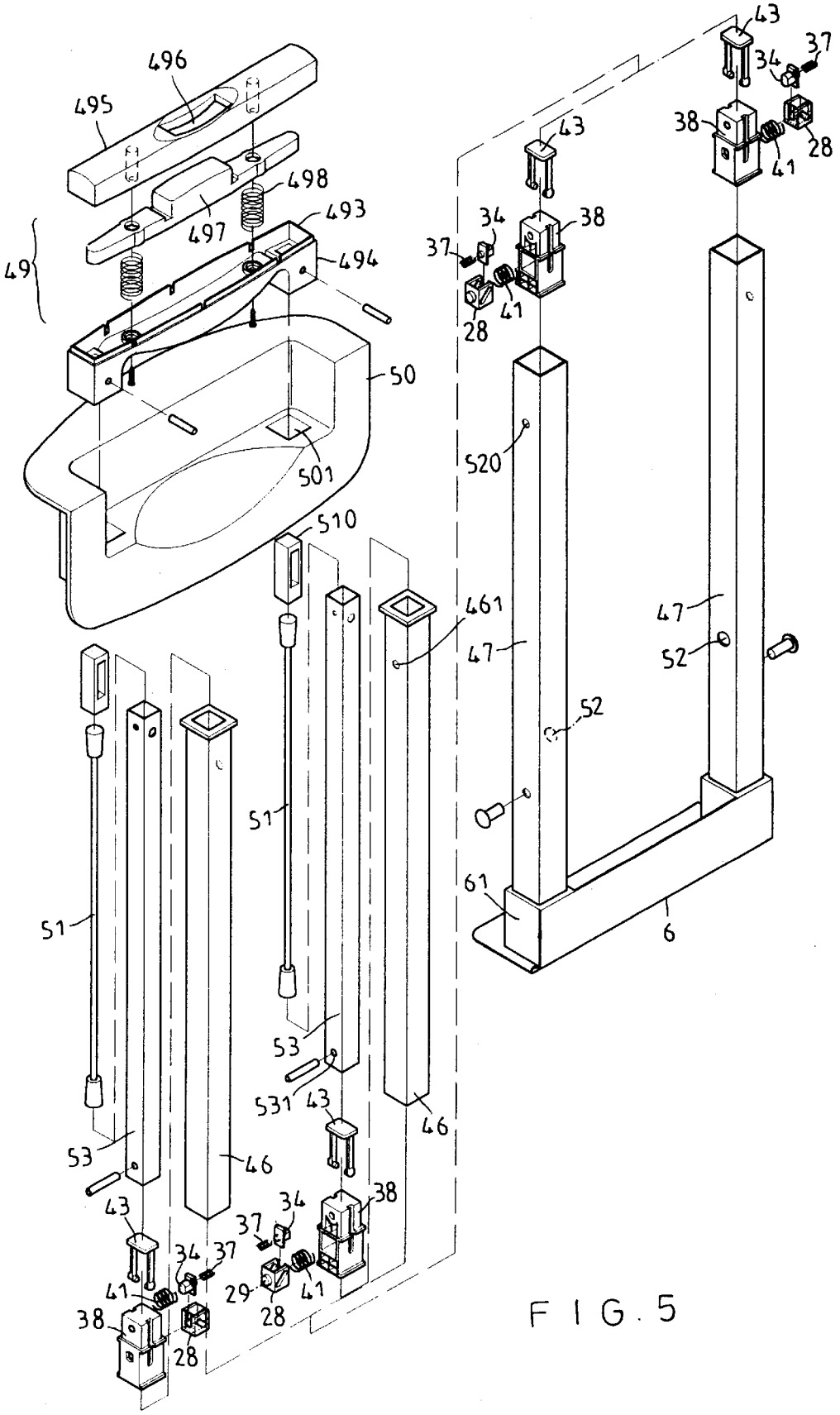
FIG. 5 is a perspective exploded view of a retractable handle assembly of a preferred embodiment in accordance with the present invention.
Figure 6:
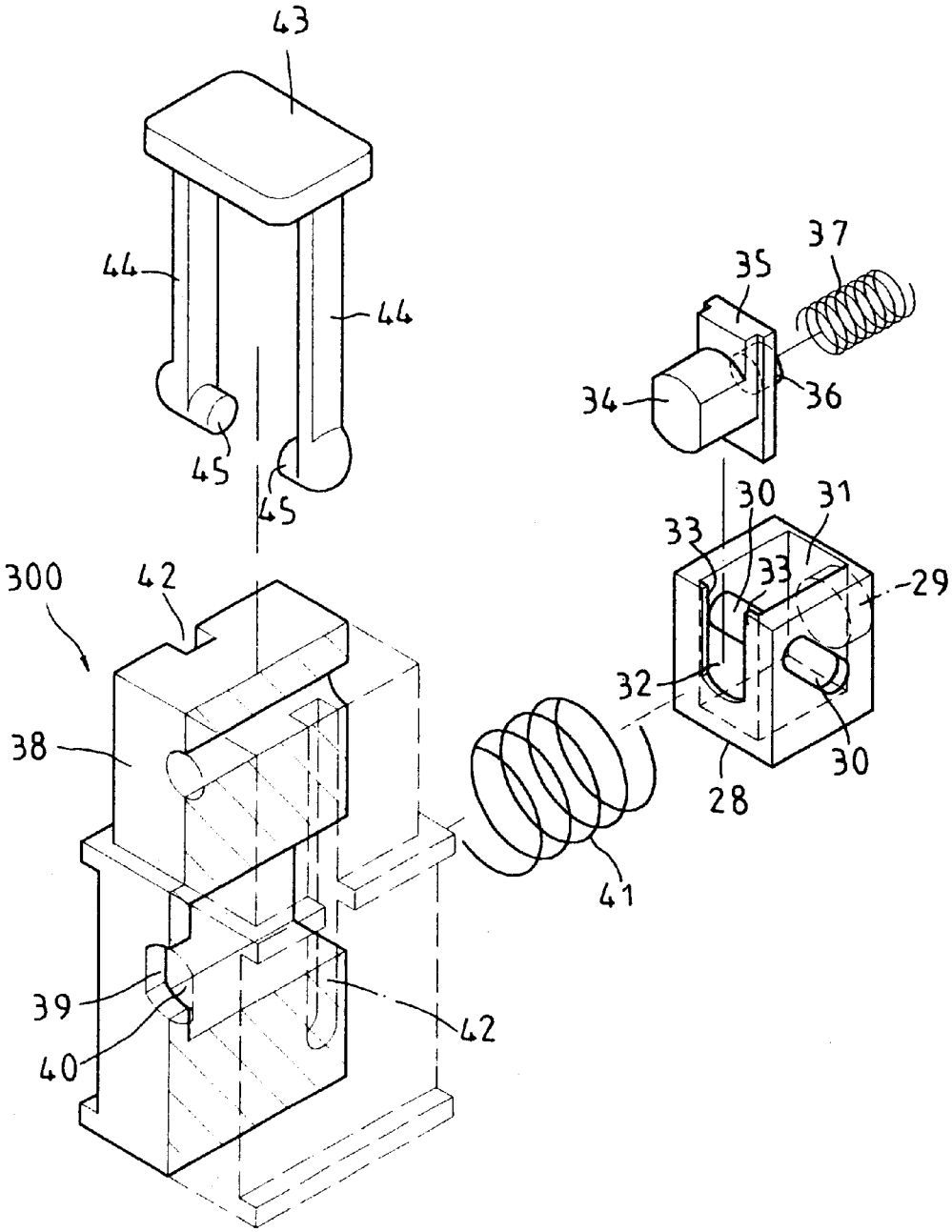
FIG. 6 is a perspective exploded view of a positioning device of a preferred embodiment in accordance with the present invention.
Figure 7:
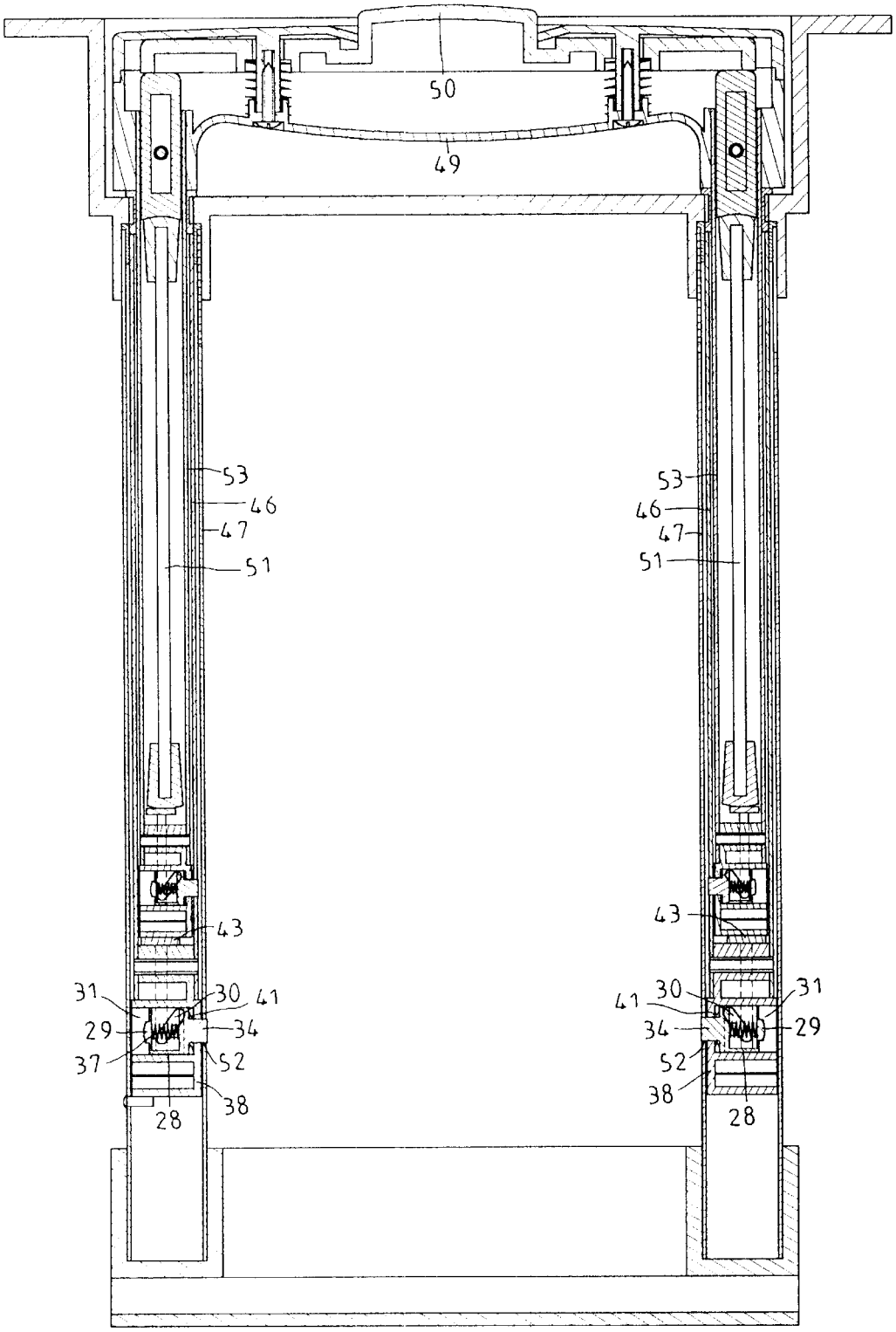
FIG. 7 is a sectional assembly view of a retractable handle assembly of a preferred embodiment in accordance with the present invention.
Figure 8:
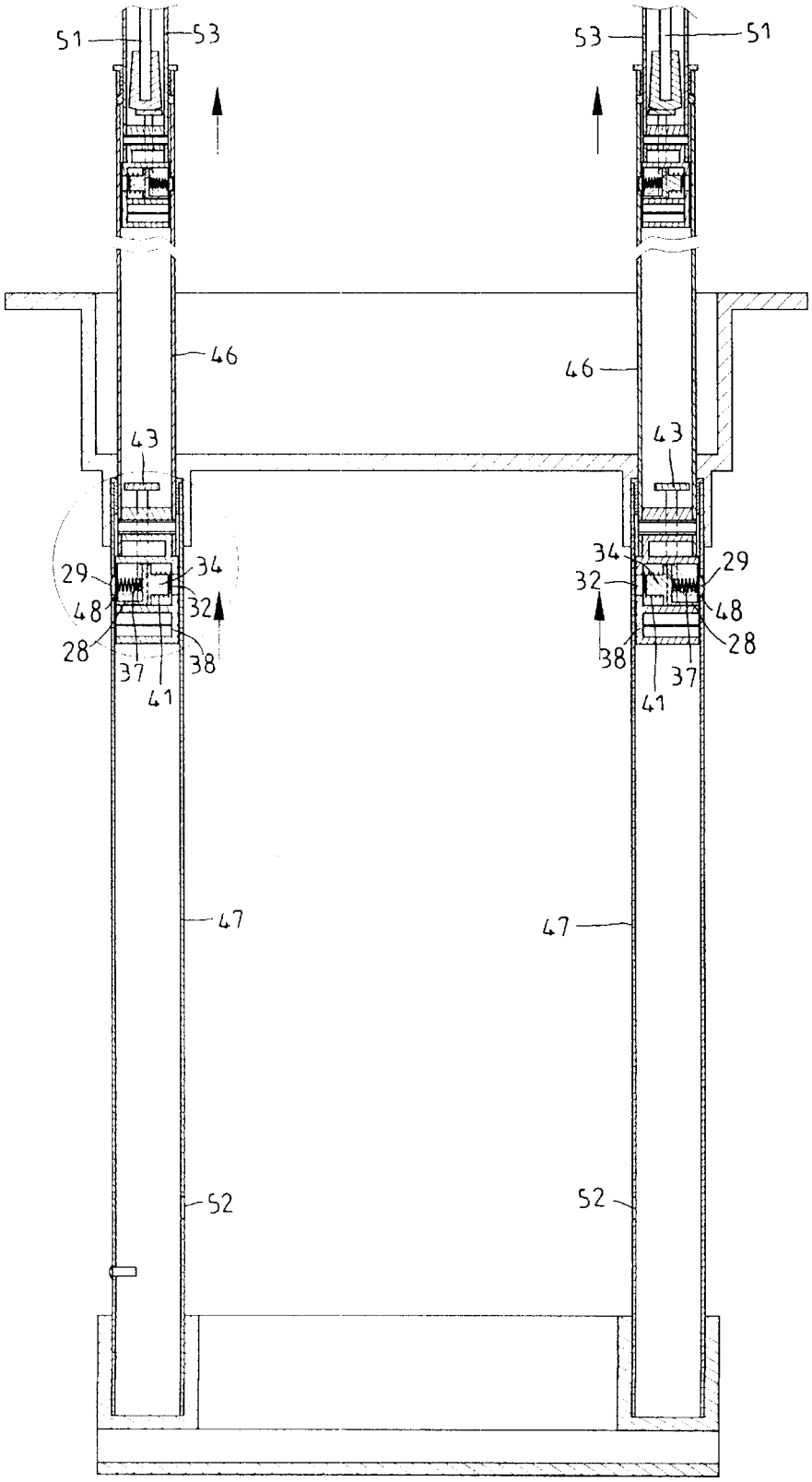
FIG. 8 is a sectional schematic view illustrating an operation of a retractable handle assembly of a preferred embodiment in accordance with the present invention.

Referring to FIGS. 5 to 8, a retractable handle assembly comprises a fixed seat 50, a grip device 49 disposed in the fixed seat 50, a pair of cubic blocks 510, a pair of driven rods 51, a pair of inner pipes 53, a pair of middle pipes 46, a pair of outer pipes 47, a base seat 6, a pair of first positioning devices 300, and a pair of second positioning devices 300. The fixed seat 50 has two oblong apertures 501.

The grip device 49 has a U-shaped seat 493 disposed in the fixed seat 50, a button plate 497 disposed in the U-shaped seat 493, two springs 498 disposed between the button plate 497 and the U-shaped seat 493, and a cover plate 495 engaging with the button plate 497.

The U-shaped seat 493 has two downward sleeves 494 matching the oblong apertures 501 of the fixed seat 50. The cover plate 495 has a center hole 496.

The inner pipes 53 are inserted through the downward sleeves 494. The cubic blocks 510 are inserted in the inner pipes 53.

The base seat 6 has two upward sleeves 61 for receiving the outer pipes 47.

The driven rods 51 are inserted in the inner pipes 53. The inner pipes 53 are inserted in the middle pipes 46. The middle pipes 46 are inserted in the outer pipes 47.

Each of the inner pipes 53 has a circular hole 531. Each of the middle pipes 46 has a round hole 461. Each of the outer pipes 47 has a circular aperture 520 and a round aperture 52.

Each of the first positioning devices 300 is disposed on a bottom of the corresponding inner pipe 53.

Each of the second positioning devices 300 is disposed on a bottom of the corresponding middle pipe 46.

Each of the first and the second positioning devices 300 has a mount 38, a clamp device 43, a hollow cube 28, a plug 35, a helical spring 37, and a coiled spring 41.

The mount 38 has two lateral slide channels 42, a guide channel 40, and an oblong hole 39 communicating with the guide channel 40.

The clamp device 43 has two elastic arms 44 and two end posts 45 disposed on the elastic arms 44.

The hollow cube 28 has a chamber 31, a U-shaped stepped flange 33, an opening 32, two lateral slant holes 30, and a disk 29.

The plug 35 has a column 34 and a pillar 36.

The plug 35 is disposed in the chamber 31 of the hollow cube 28.

The column 34 is confined by the U-shaped stepped flange 33.

The helical spring 37 is disposed between the plug 35 and the hollow cube 28. The pillar 36 is inserted in the helical spring 37.

The coiled spring 41 is inserted in the guide channel 40 of the mount 38.

The hollow cube 28 is inserted in the guide channel 40 of the mount 38.

The elastic arms 44 are inserted in the lateral slide channels 42 of the mount 38.

The end posts 45 are inserted in the lateral slant holes 30 of the hollow cube 28.

When the button plate 497 is pressed downward, each of the driven rods 51 is driven to press the clamp device 43 downward. Then the end posts 45 moves the hollow cube 28 downward.

The present invention has the following advantages. The retractable handle assembly can be operated easily. The retractable handle assembly can be assembled easily.

The present invention is not limited to the above embodiments but various modification thereof may be made. Furthermore, various changes in form and detail may be made without departing from the scope of the present invention.

I claim:

1. A retractable handle assembly comprising a fixed seat, a grip device disposed in the fixed seat, a pair of cubic blocks, a pair of driven rods, a pair of inner pipes, a pair of middle pipes, a pair of outer pipes, a base seat, a pair of first positioning devices, and a pair of second positioning devices, the fixed seat having two oblong apertures, the grip device having a U-shaped seat disposed in the fixed seat, a button plate disposed in the U-shaped seat, two springs disposed between the button plate and the U-shaped seat, and a cover plate engaging with the button plate, the U-shaped seat having two downward sleeves matching the oblong apertures of the fixed seat, the cover plate having a center hole, the inner pipes inserted through the downward sleeves, the cubic blocks inserted in the inner pipes, the base seat having two upward sleeves for receiving the outer pipes, the driven rods inserted in the inner pipes, the inner pipes inserted in the middle pipes, the middle pipes inserted in the outer pipes, each of the inner pipes having a circular hole, each of the middle pipes having a round hole, each of the outer pipes having a circular aperture and a round aperture, each of the first positioning devices disposed on a bottom of the corresponding inner pipe, and each of the second positioning devices disposed on a bottom of the corresponding middle pipe, characterized in that:

each of the first and the second positioning devices has a mount, a clamp device, a hollow cube, a plug, a helical spring, and a coiled spring, the mount has two lateral slide channels, a guide channel, and an oblong hole communicating with the guide channel, the clamp device has two elastic arms and two end posts disposed on the elastic arms, the hollow cube has a chamber, a U-shaped stepped flange, an opening, two lateral slant holes, and a disk, the plug has a column and a pillar, the plug is disposed in the chamber of the hollow cube, the column is confined by the U-shaped stepped flange, the helical spring is disposed between the plug and the hollow cube, the pillar is inserted in the helical spring, the coiled spring is inserted in the guide channel of the mount, the hollow cube is inserted in the guide channel of the mount, the elastic arms are inserted in the lateral slide channels of the mount, and the end posts are inserted in the lateral slant holes of the hollow cube.

* * * * *